US007134735B2

(12) United States Patent
Cummings

(10) Patent No.: US 7,134,735 B2
(45) Date of Patent: Nov. 14, 2006

(54) SECURITY SHELF DISPLAY CASE

(75) Inventor: John Cummings, Oakland Park, FL (US)

(73) Assignee: BBC International, Ltd., Boca Raton, FL (US)

( * ) Notice: Subject to any disclaimer, the term of this patent is extended or adjusted under 35 U.S.C. 154(b) by 397 days.

(21) Appl. No.: 10/613,288

(22) Filed: Jul. 3, 2003

(65) Prior Publication Data

US 2005/0001520 A1 Jan. 6, 2005

(51) Int. Cl.
*A47F 3/00* (2006.01)

(52) U.S. Cl. ..... 312/114; 312/257.1; 211/85.18; 211/119.005

(58) Field of Classification Search ..... 312/114, 312/140, 102, 257.1, 264, 265.5; 206/776, 206/769, 771; 220/DIG. 25, 4.21, 4.24; 108/97, 98; 211/90.01, 88.01, 85.18, 119.005
See application file for complete search history.

(56) References Cited

U.S. PATENT DOCUMENTS

| | | | | | |
|---|---|---|---|---|---|
| 1,075,369 | A | * | 10/1913 | Millice | 312/330.1 |
| 1,379,553 | A | | 5/1921 | Gloekler | |
| 1,481,415 | A | * | 1/1924 | Casper | 220/DIG. 25 |
| 1,640,870 | A | * | 8/1927 | Asplund | 217/58 |
| 1,645,470 | A | | 10/1927 | Alheit | |
| 1,948,049 | A | | 2/1934 | Rose | |
| 2,217,725 | A | * | 10/1940 | Bloomfield | 312/114 |
| 2,651,557 | A | | 9/1953 | Kelly, Jr. | |
| 2,741,390 | A | * | 4/1956 | Moore | 220/DIG. 25 |
| 3,262,746 | A | | 7/1966 | Weber | |
| 3,744,645 | A | | 7/1973 | Hochman | |
| 3,809,216 | A | | 5/1974 | Ferguson | |
| 4,002,287 | A | * | 1/1977 | Saveth | 220/DIG. 25 |
| 4,227,759 | A | | 10/1980 | Lee et al. | |
| 4,255,001 | A | * | 3/1981 | Frishman | 312/114 |
| 5,232,104 | A | | 8/1993 | Francois | |
| 5,263,576 | A | | 11/1993 | Boreen et al. | |
| 5,390,998 | A | | 2/1995 | Friedman | |
| 5,524,977 | A | | 6/1996 | Orawski | |
| 6,044,982 | A | * | 4/2000 | Stuart | 211/43 |
| 6,550,875 | B1 | * | 4/2003 | Compton et al. | 312/196 |
| 2003/0057809 | A1 | | 3/2003 | House, III et al. | |

FOREIGN PATENT DOCUMENTS

| | | | | |
|---|---|---|---|---|
| GB | 2278995 | * | 12/1994 | 312/114 |

* cited by examiner

*Primary Examiner*—Lanna Mai
*Assistant Examiner*—Hanh V. Tran
(74) *Attorney, Agent, or Firm*—GrayRobinson, P.A.

(57) ABSTRACT

A display case comprises a first section having a top wall, a bottom wall and a back wall connected between the top and bottom walls, and, a second section having opposed side walls with a front wall connected between them. The second section slides into engagement with the first section to form a closed interior. The bottom wall of the first section is integrally formed with a bracket which includes first and second arms connected in an inverse, L-shape, with one of the arms oriented parallel to and spaced from the bottom wall to form a space within which a shelf is received. A thumb screw or other mounting device extends through the bracket arm to engage the shelf and secure the display case thereto.

5 Claims, 2 Drawing Sheets

SECURITY SHELF DISPLAY CASE

FIELD OF THE INVENTION

This invention relates to display cases, and, more particularly, to a transparent display case having one-piece first and second sections which slide together and are connected to define a closed interior with a mounting bracket integrally formed on one of the sections to releasably secure the case onto a shelf.

BACKGROUND OF THE INVENTION

Retail outlets have employed a number of different techniques for displaying merchandise and promotional items to customers. Wall and floor cabinets are commonly used as permanent fixtures to display merchandise, and many of these have locking drawers or doors to prevent access to the items on display except by an employee with a key. In some instances, portable cases are used to display promotional items and products which are smaller in size such as watches, jewelry or the like. These portable cases typically rest on top of a base cabinet, or on a shelf.

A number of portable display cases have been proposed in the prior art, but each suffer from one or more deficiency. In one typical design, the display case is formed from a number of individual walls which are slid or otherwise secured together to form a transparent enclosure with a closed interior. See, for example, U.S. Pat. Nos. 5,524,977; 5,263,576 and 2,651,557. The problem with these designs is that most retailers do not have the storage area for cases which require a number of individual parts, or the staff and time to assemble such cases. It is important for the display case to be easily assembled, without special knowledge or tools, and to have a limited number of parts.

Another major issue for retailers is the problem of theft of the contents of a display case, or the entire case itself. As noted above, portable display cases intended for promotional items or other small products are most often positioned atop a base cabinet or on a wall-mounted shelf. It is desirable to secure the display case in position, without allowing access to its closed interior, but in a way which is aesthetically pleasing. The concept of mounting a display to a shelf or other support is shown, for example, in U.S. Pat. Nos. 5,390,998; 3,744,645; 1,948,049 and 1,645,470. With the exception of the '049 patent, each of these displays include a platform or pedestal which is secured to a support in combination with an enclosure or case mounted to the platform. This type of design is often aesthetically lacking, and the use of a separate platform adds an additional part which must be stored, and paid for, by the retailer.

U.S. Pat. No. 1,948,049 teaches an arrangement where two side panels of a display have spaced arms which straddle a shelf. A thumb screw extends from one of the arms into engagement with the shelf to mount the display in place. Each side panel of this design is a separate piece which must be mounted to the rest of the display, and the display itself does not have a closed interior which allows any item placed thereon to be stolen.

SUMMARY OF THE INVENTION

The display case of this invention comprises a first section having a top wall, a bottom wall and a back wall connected between the top and bottom walls, and, a second section having opposed side walls with a front wall connected between them. The second section slides into engagement with the first section to form a closed interior. The bottom wall of the first section is integrally formed with a bracket which includes first and second arms connected in an inverse, L-shape, with one of the arms oriented parallel to and spaced from the bottom wall to form a space within which a shelf is received. A thumb screw or other mounting device extends through the bracket arm to engage the shelf and secure the display case thereto.

In the presently preferred embodiment, the first and second sections are each one-piece structures with their respective walls formed of a clear plastic material such as acrylic or the like. A mirror is preferably removably mounted to the back wall of the first section, by hook and loop fastening elements or the like, to enable one to view the back of an object placed on display in the closed interior of the case. The top wall of the first section is formed with an upper lip extending in a direction toward the bottom wall, and the bracket of the bottom wall has a lower lip extending toward the upper lip and in alignment therewith. When the second section is slid into engagement with the first section, the front wall of the second section contacts each of the upper and lower lips which help to retain the two sections together. An additional mounting means for the two sections consists of a pair of flanges, one mounted to each side wall of the second section in position to contact the back wall of the first section when the two sections are engaged. At least one screw or other fastener extends through the back wall into each flange to secure the sections together.

As noted above, the bracket integrally formed in the bottom wall of the first section has an arm which is parallel to and spaced from the bottom wall. A shelf is adapted to be received within this space, and a mounting device such as a thumb screw extends from the arm into engagement with the shelf to hold the display case in a fixed position on the shelf.

With the provision of the upper and lower lips of the two sections, and the connection between the flanges and back wall, the display case of this invention provides a secure enclosure for items placed in its closed interior. The integral bracket for mounting the display in a fixed position to a shelf further adds to the security of items within the display. A would be thief cannot gain access to the interior of the display case without taking the time to remove the screws or other fasteners from the flanges. Additionally, although the mounting device which secures the case to a shelf can be loosened, it acts as deterrent for one attempting to make off with the entire case from a retail outlet.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
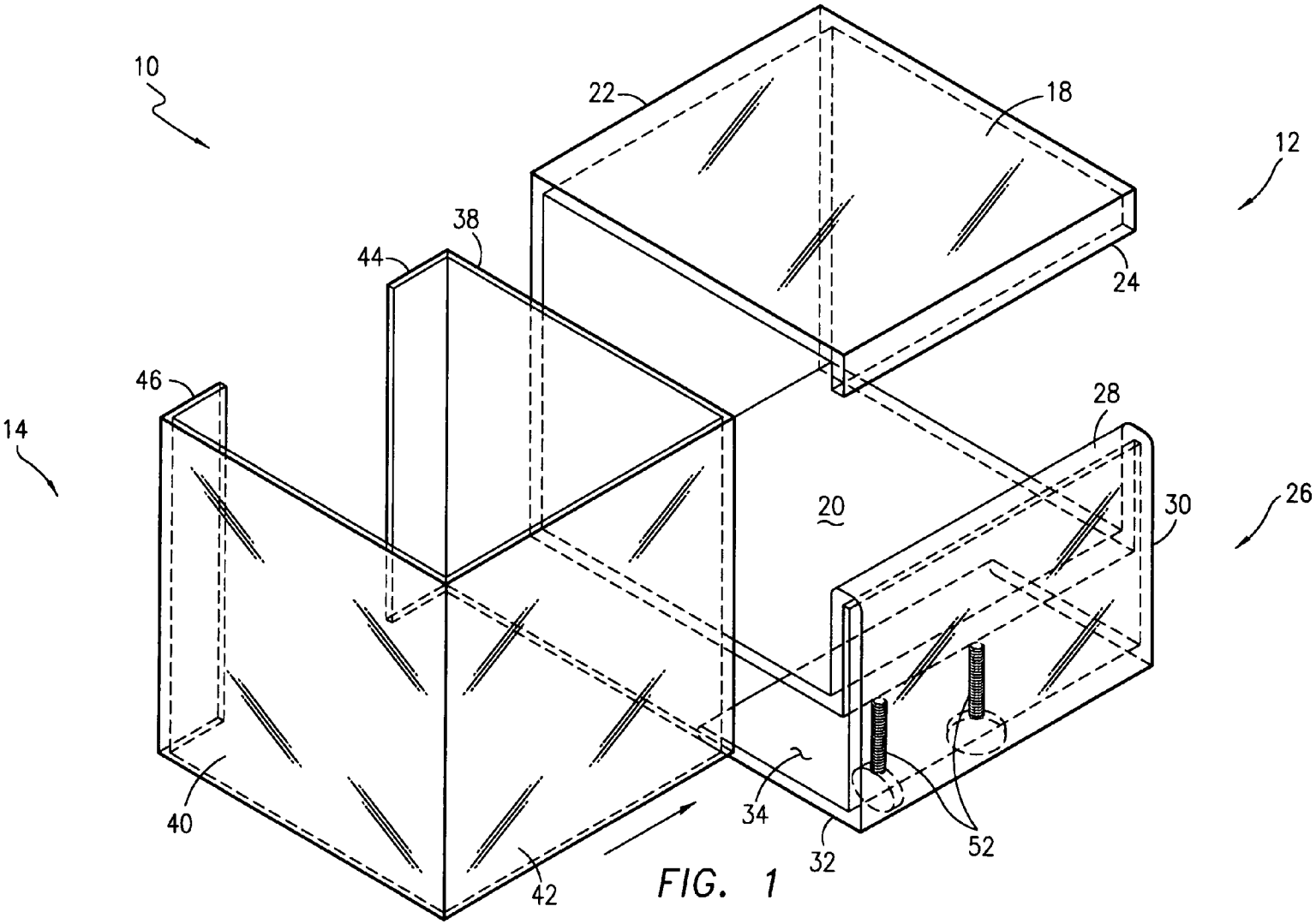
FIG. 1 is a perspective, disassembled view of the display case of this invention.
Figure 2:
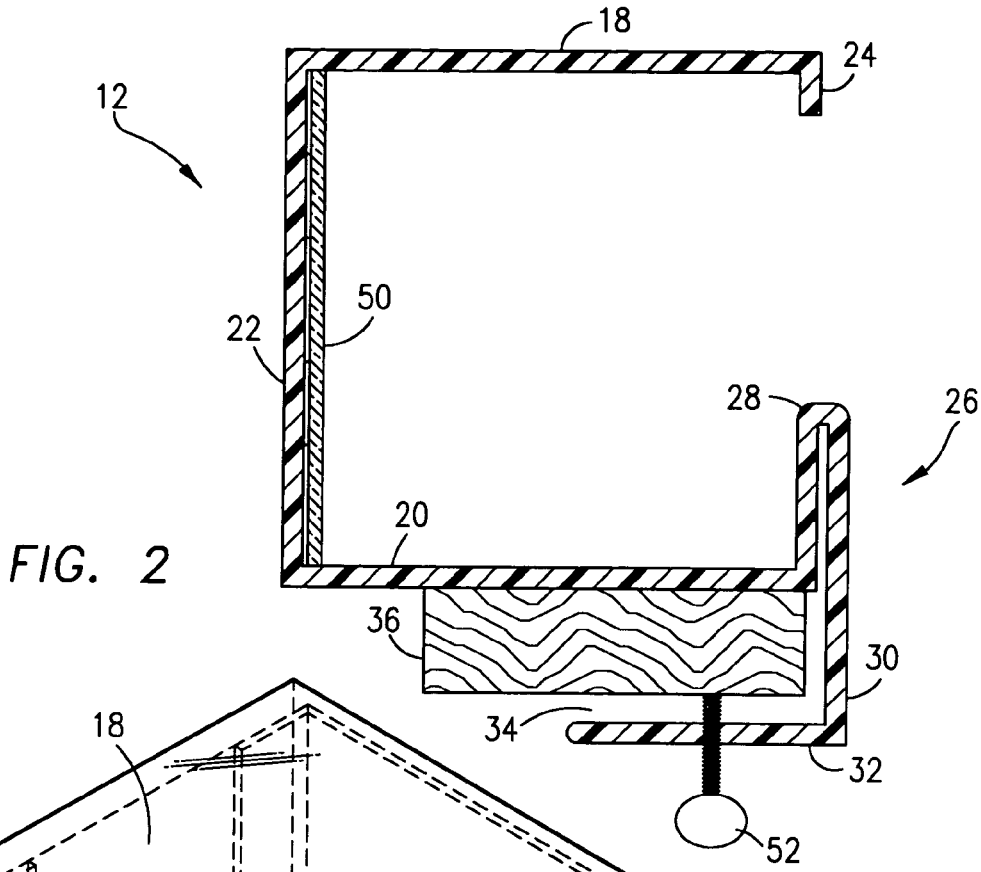
FIG. 2 is a cross sectional side view of the first section of the display case.
Figure 3:
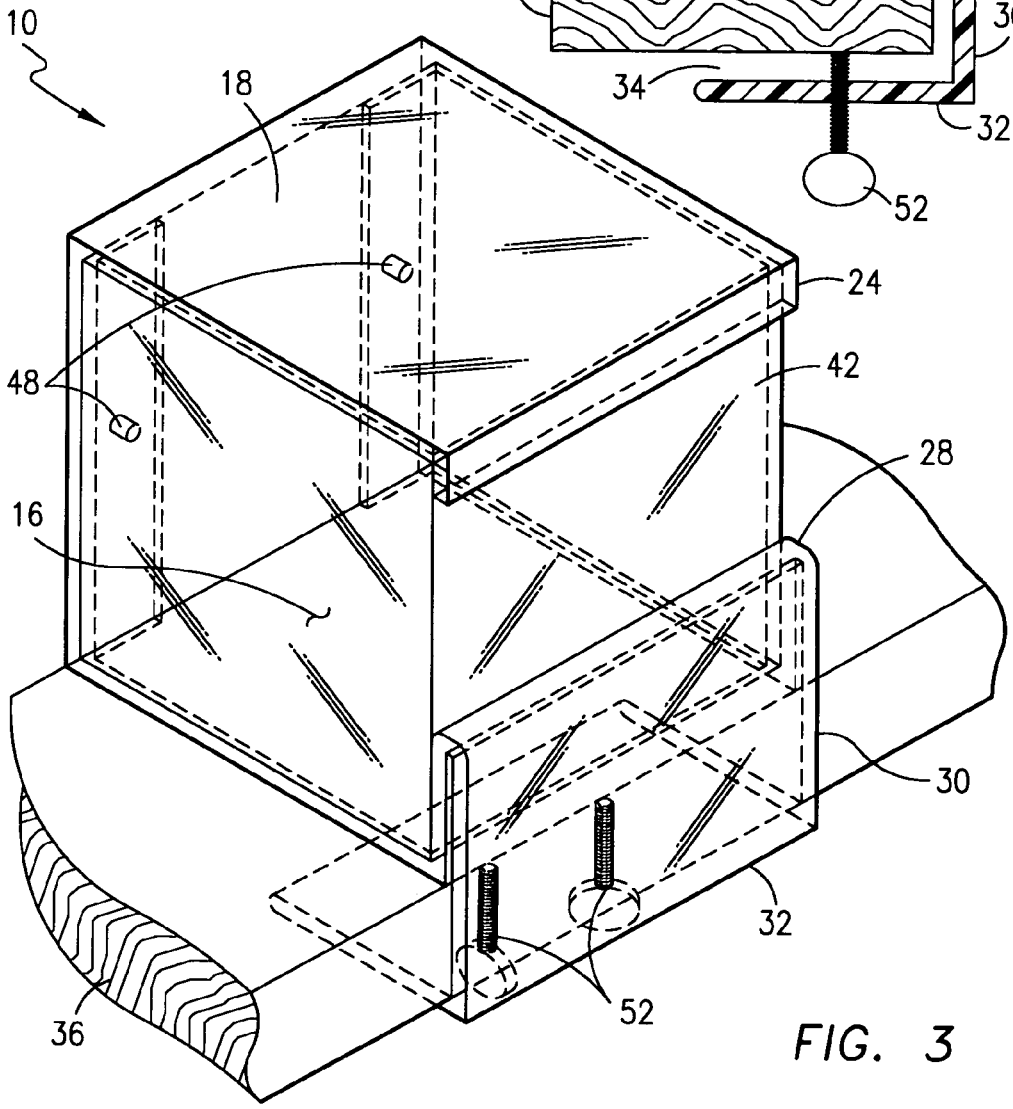
FIG. 3 is a perspective view of the assembled display case herein secured to a shelf.

Referring now to the drawings, the display case 10 of this invention includes a first section 12 and a second section 14 which are releasably interconnected to form a closed interior 16. The first section 12 comprises a top wall 18, a bottom wall 20 and a back wall 22 which is permanently connected between the top and bottom walls 18, 20 so the first section 12 has essentially a one-piece construction. An upper lip 24 extends from the top wall 18 in a direction toward the bottom wall 20. The bottom wall 20 is integrally formed with a bracket 26 which comprises a lower lip 28 protruding upwardly from the bottom wall 20 in vertical alignment with the upper lip 24, and a pair of arms 30 and 32. The first arm 30 extends vertically downwardly from the lower lip 28, in the orientation of the display case 20 depicted in the Figs., and the second arm 32 is generally perpendicular to the first arm 30 and parallel to the bottom wall 20. A space 34 is formed between the second arm 32 and bottom wall 20 which is adapted to receive a shelf 36, as schematically depicted in the Figs.

The second section 14 of the display case 10 comprises a first side wall 38, a second side wall 40 and a front wall 42 permanently connected between the side walls 38, 40 to form an essentially one-piece structure. The free edge of each side wall 38 and 40 mounts a flange 44, 46, respectively.

The display case 10 is assembled by sliding the first and second sections 12 and 14 together, sideways, until the top and bottom walls 18, 20 of the first section 12 overlie the side walls 38, 40 and front wall 42 of the second section 14. The upper and lower lips 24 and 28 of the first section 12 contact the front wall 42 of the second section 14 in the assembled position, and the flanges 44, 46 abut the back wall 22. The upper and lower lips 24, 28 assist in retaining the two sections 12, 14 together, and screws or other fasteners 48 extend through the back wall 22 into the flanges 44, 46 to provide an additional connection between the sections 12, 14.

In the presently preferred embodiment, all of the walls forming the first and second sections 12, 14 are formed of a transparent plastic material such as acrylic or the like so that an object placed in the hollow, closed interior 16 of the display case 10 is readily visible. A mirror 50 is preferably attached to the back wall 22, such as by hook and loop fastener elements or the like, to allow for easy viewing of the back of an object in the closed interior 16.

With the display case 10 assembled, it is mounted to a shelf 36 by a mounting device such as thumb screws 52 or the like. The shelf 36 is received within the space 34 between the second arm 32 and bottom wall 20, and the thumb screw 52 is then extended through the second arm 32 into engagement with the shelf 36. This retains the display case 10 in position on the shelf 36, but allows it to be released and moved to a new location as desired.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A display case, comprising:

a one-piece first section including a top wall, a bottom wall and a back wall permanently connected between said top and bottom walls, said top wall being formed with an upper lip extending toward said bottom wall, said bottom wall being formed with a bracket having a lower lip extending toward said upper lip and in alignment therewith, a first arm extending in a direction away from said lower lip and a second arm connected to said first arm, a space being formed between said bottom wall and said second arm which is adapted to receive a shelf;

a one-piece second section including a first side wall, a second side wall and a front wall permanently connected between said first and second side walls, each of said first and second side walls being formed with a flange, said second section being slid into engagement with said first section so that said front wall contacts said upper and lower lips, said flange of each of said side walls abuts said back wall and said top and bottom walls contact said front wall and said first and second side walls to form a closed interior;

a mounting device insertable through said second arm of said first section, said mounting device being adapted to contact a shelf received within said space between said bottom wall and said second arm to secure said first and second sections to the shelf;

at least one fastener extending through said back wall of said first section into said flange of each of said first and second side walls of said second section to secure said first and second sections together.

2. The display case of claim 1 in which said second arm of said bracket is substantially parallel to said bottom wall.

3. The display case of claim 1 in which said mounting device is a thumb screw which extends through said second arm of said bracket and is adapted to engage the bottom of a shelf.

4. The display case of claim 1 in which a mirror is mounted to said back wall of said first section.

5. The display case of claim 1 in which at least said first and second side wall, said top wall and said front wall are formed of a transparent material to permit viewing of said closed interior.

* * * * *